US006976529B2

(12) United States Patent
Kester

(10) Patent No.: US 6,976,529 B2
(45) Date of Patent: Dec. 20, 2005

(54) HIGH-V PLATE FIN FOR A HEAT EXCHANGER AND METHOD OF MANUFACTURING

(75) Inventor: Douglas A. Kester, York, PA (US)

(73) Assignee: York International Corporation, York, PA (US)

( * ) Notice: Subject to any disclaimer, the term of this patent is extended or adjusted under 35 U.S.C. 154(b) by 54 days.

(21) Appl. No.: 10/180,852

(22) Filed: Jun. 26, 2002

(65) Prior Publication Data

US 2003/0000686 A1 Jan. 2, 2003

Related U.S. Application Data

(60) Provisional application No. 60/301,140, filed on Jun. 28, 2001.

(51) Int. Cl.[7] ..... F28D 1/04
(52) U.S. Cl. ..... 165/151; 165/152; 62/515
(58) Field of Search ..... 165/150–153, 165/DIG. 503, 181; 62/515

(56) References Cited

U.S. PATENT DOCUMENTS

| | | | | |
|---|---|---|---|---|
| 1,553,093 | A | | 9/1925 | Modine |
| 3,796,258 | A | | 3/1974 | Malhotra et al. |
| 3,902,551 | A | | 9/1975 | Lim et al. |
| 4,365,667 | A | | 12/1982 | Hatada et al. |
| 4,469,167 | A | | 9/1984 | Itoh et al. |
| 4,580,623 | A | | 4/1986 | Smitte et al. |
| 4,691,768 | A | * | 9/1987 | Obosu ..... 165/151 |
| 4,705,105 | A | | 11/1987 | Cur |
| 4,723,599 | A | | 2/1988 | Hanson |
| 4,787,442 | A | | 11/1988 | Esformes |
| 4,860,822 | A | | 8/1989 | Sacks |
| 4,984,626 | A | | 1/1991 | Esformes et al. |
| 5,056,594 | A | | 10/1991 | Kraay |
| 5,062,475 | A | * | 11/1991 | Bemisderfer et al. ..... 165/151 |
| 5,111,876 | A | | 5/1992 | Nash |
| 5,168,923 | A | * | 12/1992 | Sacks ..... 165/151 |
| 5,353,866 | A | * | 10/1994 | Ueda et al. ..... 165/151 |
| 5,360,060 | A | | 11/1994 | Tanaka et al. |
| 5,476,140 | A | | 12/1995 | Lu |
| 5,738,168 | A | | 4/1998 | Patel et al. |
| 5,927,393 | A | | 7/1999 | Richter et al. |
| 5,937,668 | A | | 8/1999 | Jun |
| 6,125,925 | A | | 10/2000 | Obosu et al. |

* cited by examiner

*Primary Examiner*—Terrell Mckinnon
(74) *Attorney, Agent, or Firm*—McNees Wallace & Nurick LLC

(57) ABSTRACT

A fin for a heat exchanger coil assembly and a method of manufacturing the fin is provided. The fin includes a heat transfer enhancement pattern which appears sinusoidal in shape. The base wavy pattern of the enhancement pattern includes two wavelengths within each tube row and includes seven discrete segments. Six of the seven segments are circular arc segments. The seventh segment comprises two linear segments which form a condensate channel. The segments are arranged in a particular order at specific distances offset (above and below) from a leading edge nominal air streamline (LENAS) by a fraction of a nominal fin pitch $P_f$. The LENAS is related to the "normal" base wavy pattern used in other fins.

49 Claims, 11 Drawing Sheets

FIG−9

HIGH-V PLATE FIN FOR A HEAT EXCHANGER AND METHOD OF MANUFACTURING

CROSS-REFERENCE TO RELATED APPLICATIONS

This application claims the benefit of U.S. Provisional Application No. 60/301,140 filed Jun. 28, 2001.

FIELD OF THE INVENTION

The present invention relates generally to a heat exchanger fin. More specifically, the present invention relates to an enhanced pattern for a plate fin used in a plate fin/tube heat exchanger that maximizes heat transfer in all areas of the fin and a corresponding method of manufacturing the fin to have the enhanced pattern.

BACKGROUND OF THE INVENTION

Finned heat exchanger coil assemblies are widely used in a number of applications in fields such as air conditioning and refrigeration. A finned heat exchanger coil assembly generally includes a plurality of spaced parallel tubes through which a heat transfer fluid such as water or refrigerant flows. A second heat transfer fluid, usually air, is directed across the tubes. A plurality of fins is usually employed to improve the heat transfer capabilities of the heat exchanger coil assembly. Each fin is a thin metal plate, made of copper or aluminum, which may or may not include a hydrophilic coating. Each fin also acts as a tubesheet and includes a plurality of apertures for receiving the spaced parallel tubes, such that the tubes generally pass through the plurality of fins at right angles to the fins. The fins are arranged in a parallel, closely spaced relationship to one another along the tubes to form multiple paths for the air or other heat transfer fluid to flow across the fins and around the tubes.

In heat exchanger coil assemblies, it is desirable to maximize the amount of heat transfer within a given coil. Once way to increase heat transfer is to increase the size of the fin. However, increasing the size of the fin leads to a larger device and to a higher, air-side pressure drop, both of which are undesirable. "Pressure Drop" is the air pressure difference required to maintain air flow through the heat exchanger coil assembly. High pressure drop is undesirable since the energy required to keep air flowing through the coil assembly is proportional to the pressure drop across the coil assembly. Higher coil pressure drop leads to higher energy (typically electrical) usage, for a given building HVAC system.

In a heat exchanger coil assembly for dehumidifying air, relatively warm and humid air flows into the coil, and as the air becomes cooler, it becomes saturated with water. At some point, the cooled air reaches its dew point and is unable to hold moisture as it is cooled further, resulting in condensation on the fin plate. The resulting condensate on the fin inhibits heat transfer between the fin and the air. The condensate is typically removed from the fin plate by one of two mechanisms. The first mechanism is gravity-induced drainage along the fin surface into a pan located under the coil assembly. This mechanism of condensate removal is desirable, and results in plate fins being oriented vertically in dehumidification coils. The second mechanism for condensate removal is entrainment of condensate droplets by the airflow exiting the coil. This mechanism of condensate removal is typically undesirable, since it can lead to problematic biologic activity on downstream surfaces of the equipment housing the coil assembly. Thus, it is desirable to provide the fin with a structure that minimizes the condensate inventory residing on the fin surface, facilitates and maximizes gravity-induced drainage of condensate from the coil assembly, and inhibits entrainment of condensate droplets into the exiting airflow. To solve these problems, some fins are produced or manufactured having complex geometries which are difficult and expensive to manufacture.

Therefore, what is needed is a fin geometry that is simple and inexpensive to manufacture while maximizing the heat transfer capabilities of the fin. In addition, a fin geometry is needed that can remove moisture from the air passing over the fin and reduce the amount of condensation that is permitted to reside on the fins.

SUMMARY OF THE INVENTION

In one embodiment of the present invention, a heat exchanger coil assembly is provided. The heat exchanger coil assembly includes a plurality of fins and a plurality of heat transfer tubes. Each fin has a heat transfer enhancement pattern, which is made up of seven discrete segments within each tube row. The shape and placement of these segments forces the over-tube fluid streamlines to tend toward a sinusoid-like pattern having two wavelengths within each tube row. The sinusoid-like pattern passing through the leading edge of the fin is termed the Leading Edge Nominal Air Streamline, and it is represented by the acronym "LENAS." The segments are offset, perpendicular to a mean airflow direction, from the LENAS by a fraction of a nominal fin pitch, $P_f$.

In another embodiment of the present invention, in a finned heat exchanger coil assembly configured for heat transfer to take place between a first fluid flowing through a plurality of spaced apart finned heat transfer tubes and a second fluid flowing outside of the tubes, a fin comprises a heat transfer enhancement pattern. The heat transfer enhancement pattern of each fin includes seven discrete segments within each tube row. The shape and placement of these segments forces the over-tube fluid streamlines to tend toward a sinusoid-like pattern having two wavelengths within each tube row. The segments are offset, perpendicular to a mean airflow direction, from the LENAS by a fraction of a nominal fin pitch, $P_f$.

In still another embodiment of the present invention, a heat exchanger coil assembly includes a plurality of heat transfer tubes. The plurality of heat transfer tubes are positioned into at least one row and are disposed substantially parallel to one another. The coil assembly also includes a plurality of fins. The plurality of fins are disposed substantially perpendicular to the plurality of heat transfer tubes and substantially parallel to one another and are separated from each other by a preselected distance. Each fin of the plurality of fins has a predetermined pattern for each row of heat transfer tubes. The predetermined pattern of each fin has a substantially sinusoidal shape and seven discrete segments. Each segment of the seven discrete segments is disposed with respect to a predefined reference shape. Finally, at least one segment of the seven discrete segments is disposed at an offset of a first distance from the predefined reference shape and at least one other segment of the seven discrete segments is disposed at an offset of a second distance greater than the first distance from the predefined reference shape.

In a further embodiment of the present invention, a fin plate for a heat exchanger coil assembly has a predetermined fin pitch and a plurality of tubes arranged into a plurality of rows. The fin plate includes a predetermined pattern for each row of tubes. The predetermined pattern has a substantially sinusoidal or sinusoid-like shape and seven discrete segments. Each segment of the seven discrete segments is disposed with respect to a predefined reference shape. At least one segment of the seven discrete segments is disposed at an offset from the predefined reference shape by a first fraction of the predetermined fin pitch and at least one other segment of the seven discrete segments is disposed at an offset from the predefined reference shape by a second fraction of the predetermined fin pitch.

Another embodiment of the present invention is directed to a method of manufacturing a fin plate for a heat exchanger coil assembly having a predefined fin pitch and a plurality of tubes arranged into a plurality of rows. The method includes the step of defining a reference shape for the fin plate. The reference shape has a substantially sinusoidal shape and corresponds to a nominal air streamline. Another step is providing a first die to form a first predetermined pattern into the fin plate. The first predetermined pattern is formed with respect to the reference shape. Still another step is forming the reference shape in the fin plate with the first die. Yet another step is raising a section of the fin plate above the reference shape by a first distance with the first die to form the first predetermined pattern into the fin plate. A further step is providing a second die to form a second predetermined pattern into the fin plate. The second predetermined pattern has a plurality of segments and at least one segment of the plurality of segments is offset from the first predetermined pattern by a first distance and at least one other segment of the plurality of segments is offset from the first predetermined pattern by a second distance. The method also includes the steps of: slitting the fin plate with the second die to define the plurality of segments; offsetting the at least one segment of the plurality of segments from the first predetermined pattern by the first distance with the second die; and offsetting the at least one other segment of the plurality of segments from the first predetermined pattern by the second distance with the second die to form the second predetermined pattern.

One advantage of the present invention is the production of a high, air-side, convective heat transfer coefficient and a relatively low air-side pressure drop. The positioning and size of the fin enhancement segments prevent the wake of any one segment from interfering with the heat transfer capabilities of at least the next two downstream segments. The impact of each segment's thermal wake on the heat transfer capability of downstream segments is therefore minimized.

Another advantage of the present invention is that it minimizes the deleterious impact of fin-surface condensate on heat transfer by promoting gravity-induced drainage of condensate along the fin surface. The first fin segment of each tube row forms a relatively sharp crease, or condensate channel, that spans the entire height of the fin without interruption. Surface tension forms a relatively thick condensate film on the concave side of the crease, where the condensate also happens to be shielded from the viscous drag of the airflow, resulting in relatively large condensate drainage velocities.

A further advantage of the present invention is that it provides a relatively high airflow face velocity with respect to incipient condensate carryover. If condensate droplets are entrained by the airflow, the sinusoidal shape of the air streamline and the positioning of the fin enhancement segments can redeposit the condensate droplets back on the fin surface within a short airflow travel distance of a fraction of a tube row.

Still another advantage of the present invention is that it minimizes the pressure drop penalty typically produced by sinusoidal fin enhancement shapes. The division of the fin enhancement into discrete segments that are offset from the LENAS kinematically blocks the development of the secondary flow patterns that tend to form adjacent to curved fluid flow boundaries.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
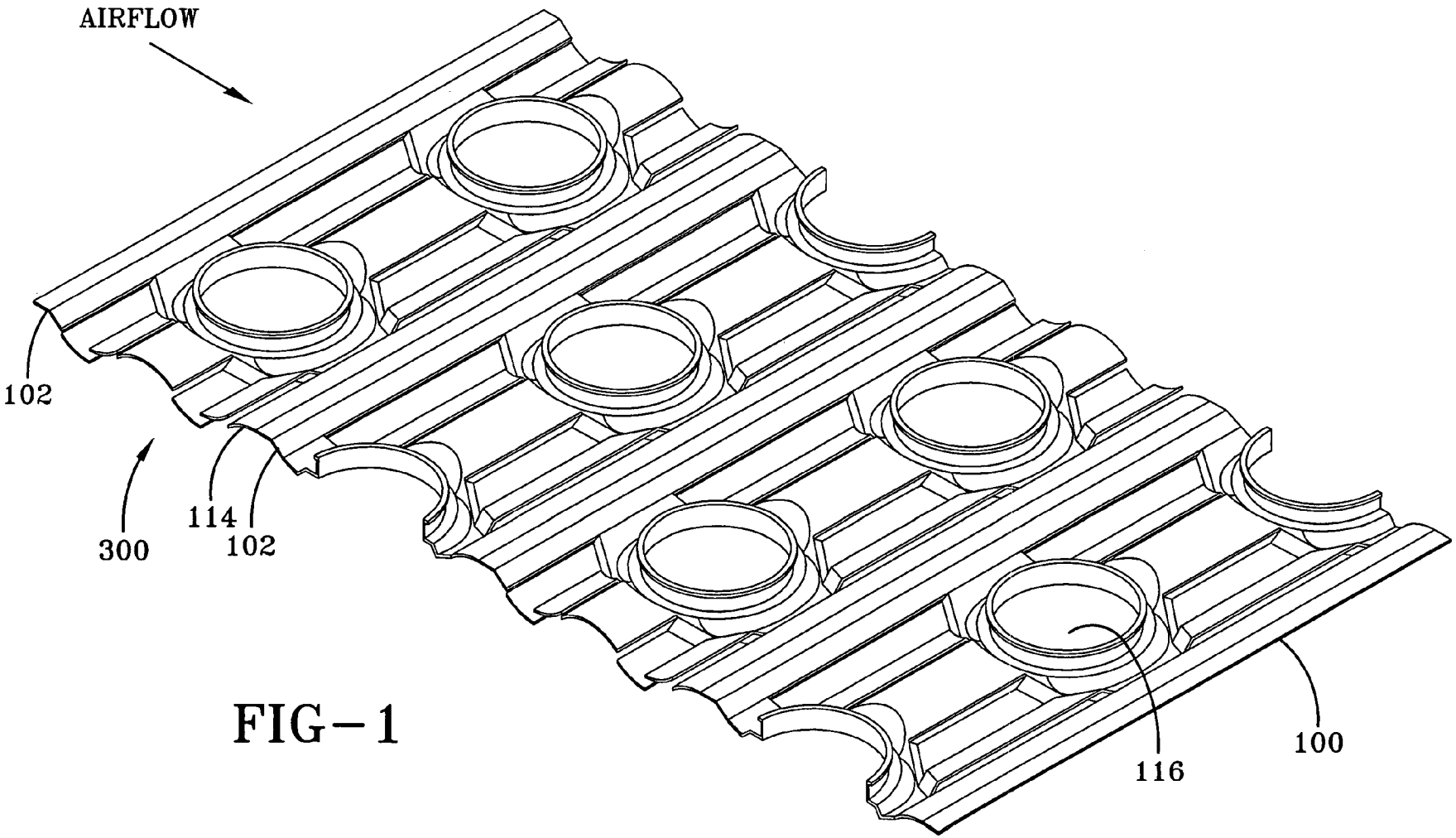
FIG. 1 is an isometric view of a small portion of a staggered tube pattern heat exchanger fin having an enhanced heat transfer pattern of the present invention.
Figure 2:
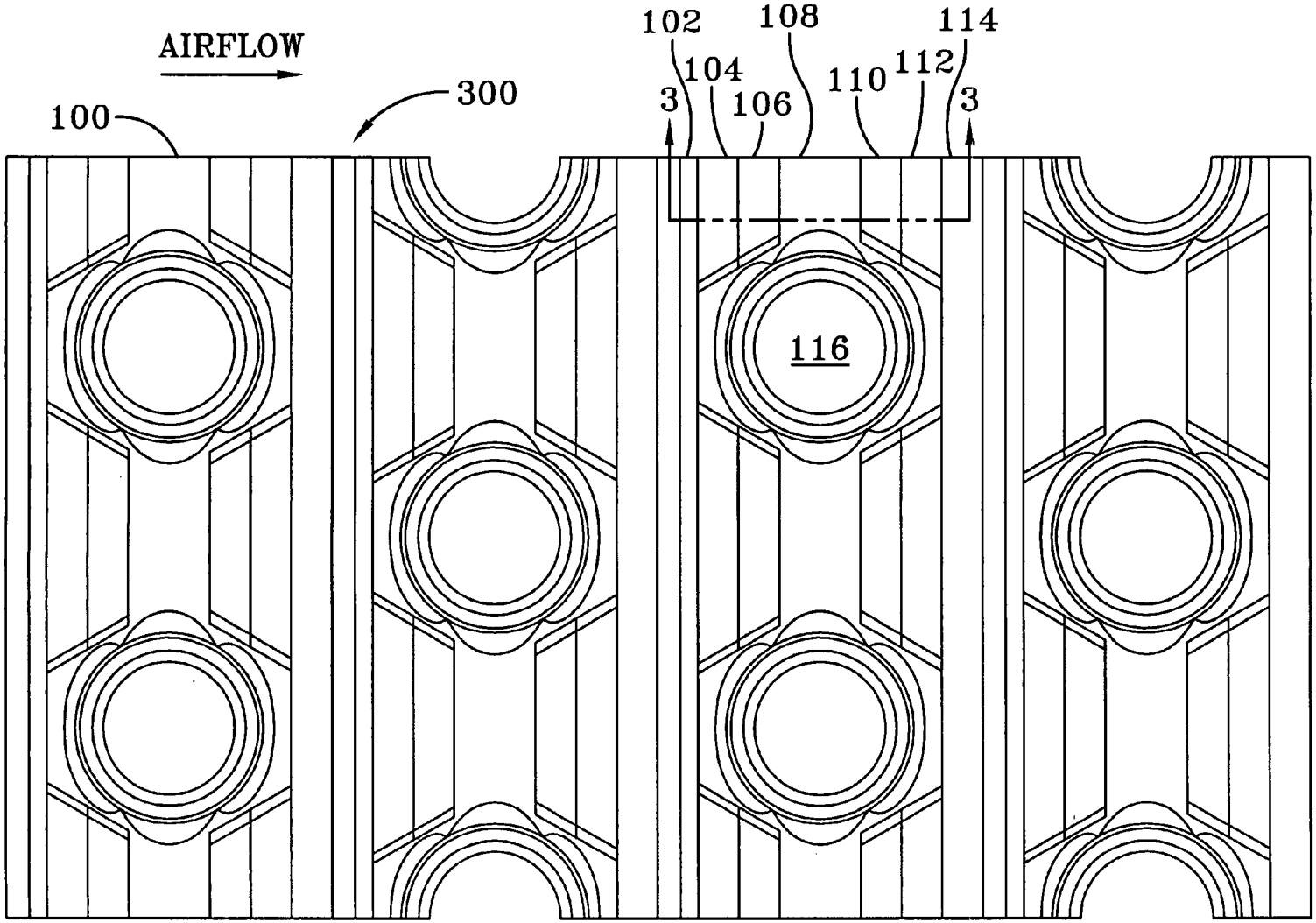
FIG. 2 is a top view of the heat exchanger fin of FIG. 1.

FIGS. 1 and 2 illustrate one embodiment of a fin 100 having the enhanced heat transfer pattern 300 of the present invention. The fin 100 is preferably incorporated into a heat exchanger, and more preferably a heat exchanger coil assembly, to enhance the heat transfer capabilities of the heat exchanger. The enhanced heat transfer pattern 300 is configured to maximize heat transfer in all areas of the fin 100.

Figure 11:
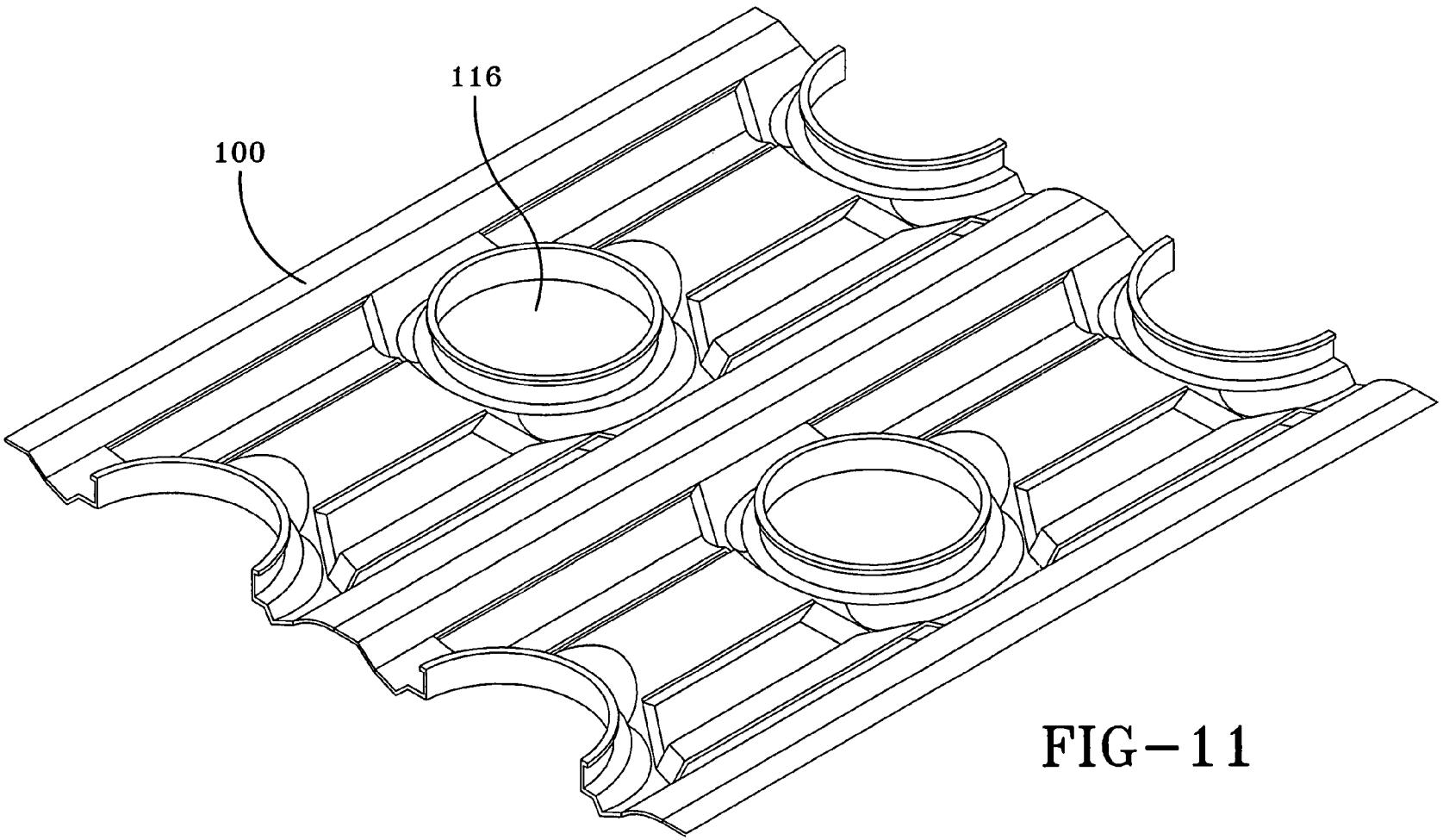
FIG. 11 is an isometric view of a in-line tube pattern heat exchanger fin having the enhanced heat transfer pattern of the present invention.

The enhanced heat transfer pattern 300 has seven distinct and discrete segments 102–114, which segments 102–114 will be described in greater detail below. The segments 102–114 of the enhanced heat transfer pattern 300 are substantially parallel to each row of tubes and can be repeated along the width of the fin 100 an additional number of times, as necessary to correspond to the number of tube rows. The width of the fin 100 is measured in a direction parallel to the direction of airflow through the heat exchanger. The number of times the enhanced heat transfer pattern 300 is repeated along the width of the fin 100 is dependent on the particular heat exchanger into which the fin 100 is incorporated. The heat exchanger includes a plurality of tubes for the passage of a heat transfer fluid, which operation of the heat exchanger will be described in greater detail below. The fin 100 includes a plurality of apertures or openings 116 to receive the plurality of tubes of the heat exchanger. The positioning of the apertures 116 on the fin 100 is dependent upon the particular configuration of the tubes of the heat exchanger. For example, in one embodiment of the fin 100 as shown in FIGS. 1 and 2 the apertures 116 are arranged or positioned in four rows, with the apertures in adjacent rows being offset from one another and apertures 116 in alternate rows being aligned with one another in a staggered tube pattern. In another embodiment of the fin 100 shown in FIG. 11, the apertures 116 are positioned and arranged in two rows with the apertures 116 in adjacent rows being aligned with one another in an in-line tube pattern. It is to be understood that the above examples of the positioning and arrangement of the apertures 116 in the fin 100 are not intended to be limiting, with other arrangements being possible, and a specific positioning and arrangement of the apertures 116 of the fin 100 is dependent on the particular heat exchanger application.

Figure 3:
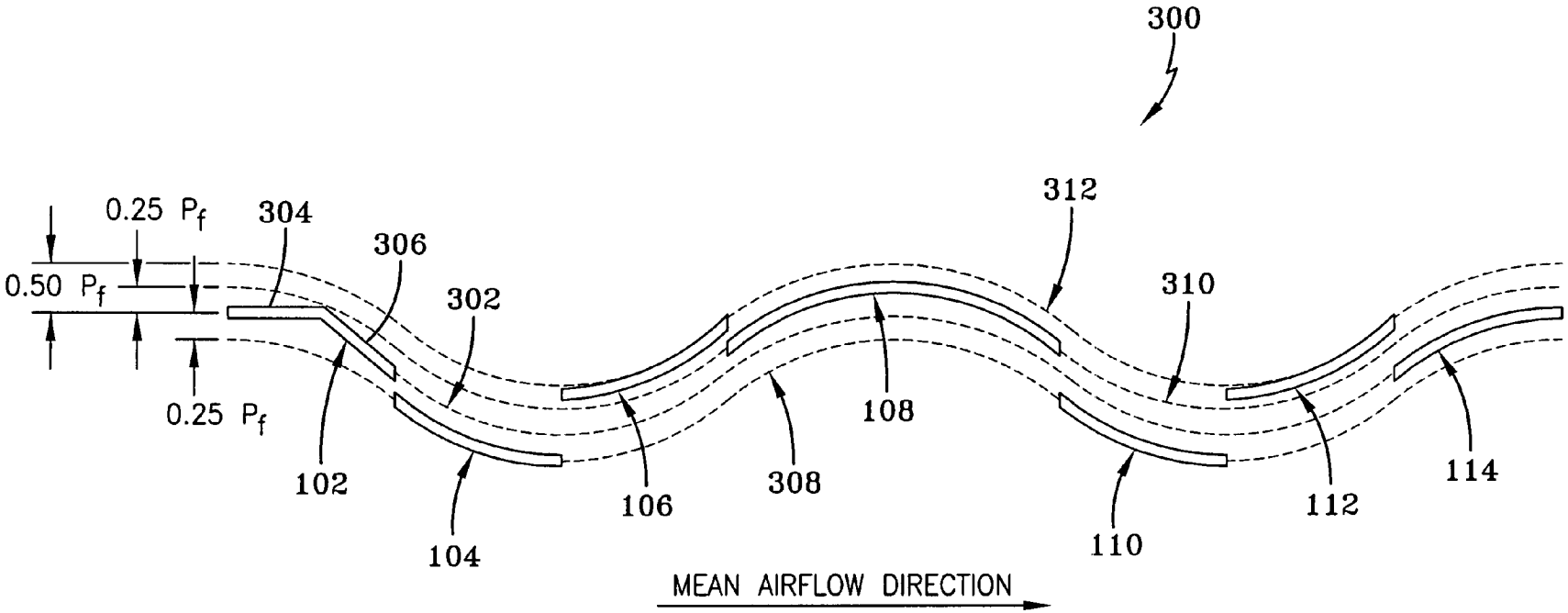
FIG. 3 is a sectional side view of the heat exchanger fin taken along line 3—3 of FIG. 2.
Figure 4:
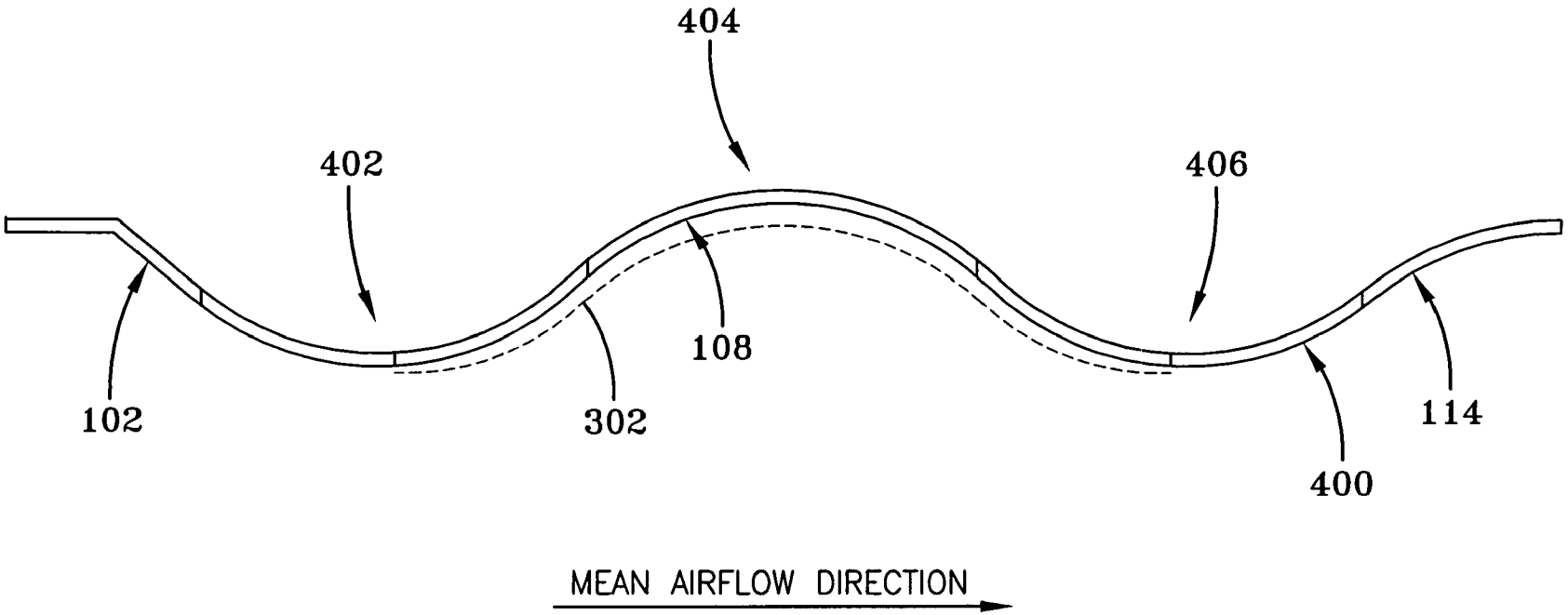
FIG. 4 is a side view of a portion of a fin having an enhanced base wavy pattern of the present invention.
Figure 8:
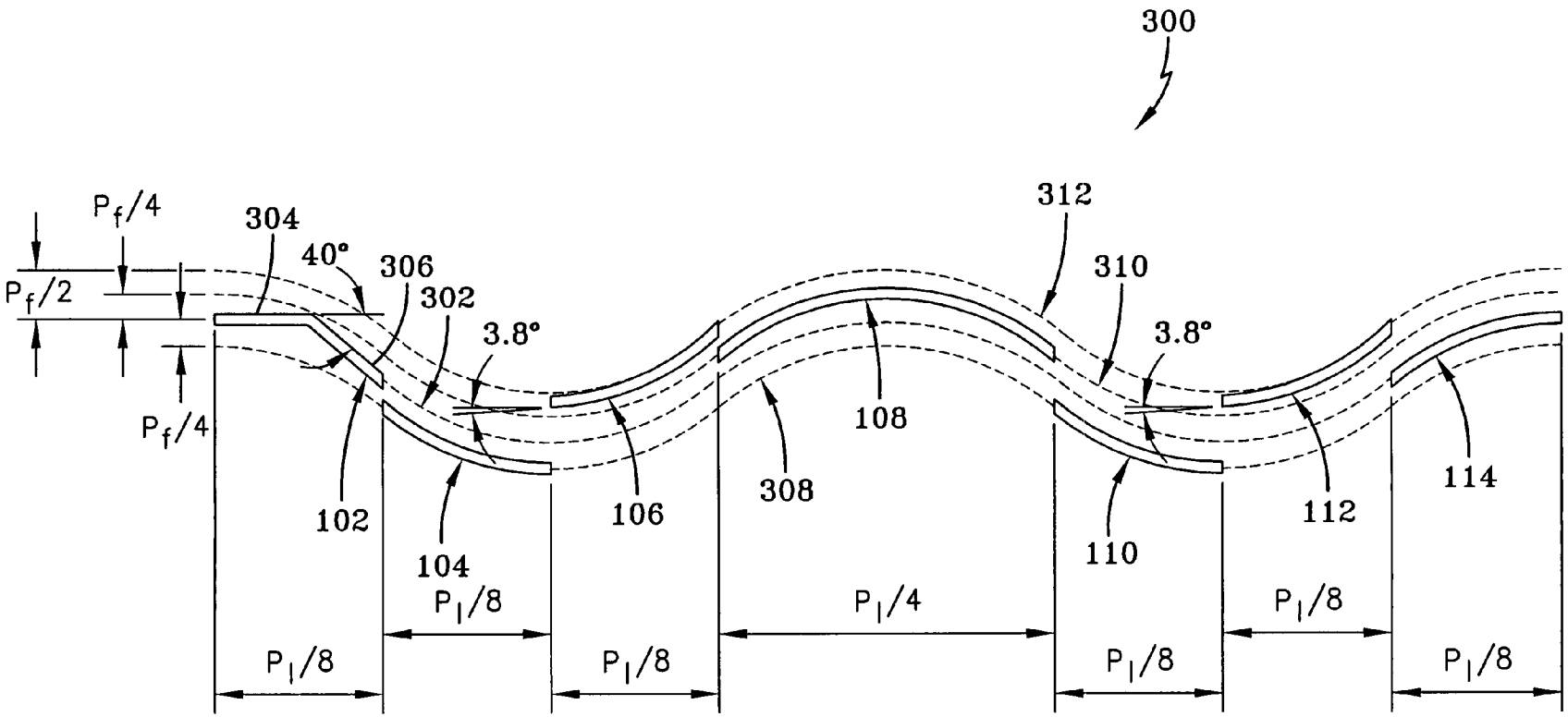
FIG. 8 is a side view of a portion of an enhanced fin according the present invention.

FIGS. 3 and 8 illustrate a side view of the fin 100 with the enhanced heat transfer pattern 300 of the present invention. As discussed above, the enhanced heat transfer pattern 300 includes seven discrete segments 102–114. The enhanced heat transfer pattern 300 is based on an enhanced base wavy pattern 400, which is shown in FIG. 4 and will be described in greater detail below. The enhanced base wavy pattern 400 has a substantially sinusoidal shape and is designed and used to simplify the manufacturing of a fin 100 having the enhanced heat transfer pattern 300 from base fin plate or stock. The manufacturing process of a fin 100 having the enhanced heat transfer pattern 300 will be described in greater detail below.

The dimensions of the enhanced base wavy pattern 400 and the enhanced heat transfer pattern 300 for the fin 100 are derived from the specific fin pitch, $P_f$, and longitudinal tube pitch, $P_l$, of the optimal heat exchanger application of the fin 100. While only one fin pitch, $P_f$, is used to define the enhancement geometry, the resulting fin can be applied to coil assemblies having a different fin pitch. However, the enhanced heat transfer pattern 300 is preferably most effective when applied to a coil assembly having the fin pitch used as the basis for the enhancement design. The fin pitch, $P_f$, is a measurement of the spacing of two adjacent fins 100 in the heat exchanger application, measured in a direction parallel to the tubes' centerlines or is a preselected distance between adjacent fins. The longitudinal tube pitch, $P_l$, is a measurement of the distance between the aperture center points of two adjacent rows of apertures 116 in the fin 100, measured in a direction perpendicular to a plane including the centerlines of the tubes when installed within a given row.

A Leading Edge Nominal Air Streamline ("LENAS") is an imaginary reference curve that is made up of congruent, circular arc segments joined together at their points of tangency, forming a pattern that resembles a sine wave. The LENAS preferably corresponds to a "normal" base wavy pattern 302 used in prior heat exchanger fins. The "normal" base wavy pattern or LENAS 302 is used to define the shape of the enhanced heat transfer pattern 300 of the preferred embodiment of the present invention. The LENAS 302 has a wavelength of about $P_l/2$, a maximum inclination from the mean airflow direction of about 40 degrees, and a phase that positions half of its peaks (or troughs, depending on an arbitrary 180 degree flip of the fin) on planes including the centerlines of the tubes when installed within a given row.

The placement of the seven discrete segments 102–114 of the enhanced heat transfer pattern 300 is obtained by offsetting portions of the LENAS 302 as shown in FIG. 3. The segments 102–114 of the enhanced heat transfer pattern can be considered to be lances or louvers of the fin 100. The enhanced heat transfer pattern 300 repeats throughout the fin 100 depending on the specific heat exchanger application and the number of rows of tubes in the heat exchanger application. Six of the seven segments 104–114 are circular arc segments or parabolic segments. The seventh segment 102 has two substantially linear portions that form a condensate channel. The segments 102–114 are arranged in a particular order at specific distances offset, above and below, the LENAS 302.

The positioning of the segments 102–114 of the enhanced heat transfer pattern 300 of the fin 100 is described relative to the LENAS 302 shown with a dashed line in FIG. 3. As discussed above, there are two wavelengths of the LENAS 302 included in the enhanced heat transfer pattern 300 corresponding to a row of apertures 116, and the seven discrete portions or segments 102–114, which for ease in identification will be referenced as segments "A"–"G", extend over or across the two wavelengths of the LENAS 302 included in the enhanced heat transfer pattern 300.

Segment "A" 102 of the preferred embodiment of the enhanced heat transfer pattern 300, as shown in FIG. 3, begins at a midpoint between two adjacent rows of apertures 116 and extends to the first inflection point of the LENAS 302. Segment "A" 102 includes two linear portions which form a condensate channel. The first portion 304 is tangent to the LENAS 302 at the midpoint between the adjacent rows of apertures, and the second portion 306 is tangent to the LENAS 302 at its first inflection point. Segment "A" 102 is placed in its final position in the enhanced heat transfer pattern 300 during manufacturing or application of the enhanced base wavy pattern 400 to the fin stock. In another embodiment of the present invention, segment "A" 102 can be used with a fin having a heat transfer pattern with a shape similar to the LENAS 302. The use of segment "A" 102 in this embodiment, provides the fin with a condensate channel to remove condensate from the fin.

Preferably, the first portion 304 and the second portion 306 of segment "A" 102 forms an angle of approximately 40 degrees as shown in FIG. 8, and this angle acts as a condensate channel to transport condensate off the fin 100. As can be seen in FIGS. 1 and 2, segment "A" 102 is continuous across the height of the fin 100 (the height of the fin 100 being measured perpendicular to the direction of the airflow through the heat exchanger application), i.e. segment "A" 102 is not interrupted or broken by the corresponding collar structure or portion for the apertures 116 (the collar structure surrounding the apertures 116 is described in greater detail below with regard to the embodiment shown in FIGS. 7 and 12), thereby creating a "condensate superhighway" or condensate channel to transport condensate off the fin 100. Since condensate flows by gravity through the condensate channel, segment "A" 102 is aligned substantially perpendicular to the ground or with a substantial perpendicular component to the ground, i.e. segment "A" 102 has a substantially vertical orientation. Condensate gathers in the sharp angle due to the surface tension of the condensate, forming a thicker than average condensate film on the concave side of the angle. This increased thickness of the condensate film increases the speed at which it flows off the fin 100, due to gravity, relative to a thinner film. In addition, because the condensate gathers on the concave side of the angle, the condensate is shielded from the airflow and is therefore less likely to be re-entrained by the airstream.

Three fluid mechanical phenomena explain the operation of the condensate channel. First, a liquid's surface tension increases the thickness of a thin liquid film on a wettable, solid surface in the immediate vicinity of the concave side of a sharp corner or crease in the surface. Second, thicker liquid films flow down vertical walls under the influence of gravity faster than thinner liquid films. Third, the corner shields the thicker liquid film adjacent to it from cross-flowing air.

The first mechanism can be explained by surface tension's tendency to minimize a liquid's surface area. Surface tension makes small droplets of water take the shape of spheres, since a sphere has the smallest surface area-to-volume ratio of any three-dimensional body of a given internal volume. In just the same way, surface tension rounds the surface of thin liquid films adhering to wettable surfaces. For example, if the surface contains a crease with a radius of curvature of 0.5 mm, the radius of curvature of an adjacent, 0.1 mm-thick water film will be substantially greater, such as 1 mm.

The second mechanism is an intuitive characteristic of open-channel flow. Just as a river's water level increases during periods of heavy rain, when it is carrying a greater-than-average flow of water, a thick film of water running down a vertical wall will carry a greater flow of water down the wall than a thin film.

Finally, the third mechanism is a well-known fluid-dynamic phenomenon. Two-dimensional flow of an incompressible fluid adjacent to a wall having an angle of less than 180 degrees always produces a stagnation point (point of zero velocity) at the corner. An idealized flow pattern illustrating this phenomenon is named "Faulker-Skan Wedge Flow".

Segment "B" 104 of the preferred embodiment of the enhanced heat transfer pattern 300 begins at the first inflection point of the LENAS 302 and extends to the first trough 402 of the LENAS 302 (see FIG. 4). Segment "B" 104 includes a fraction of one circular arc segment of the LENAS 302 offset downward by ¼ nominal fin pitch, $P_f$. Offset pattern 308 shown on FIG. 3 illustrates the LENAS 302 shifted or offset downward by ¼ nominal fin pitch, $P_f$.

Segment "C" 106 of the preferred embodiment of the enhanced heat transfer pattern 300 starts or begins at the first trough 402 of the LENAS 302 and extends to the second inflection point of the LENAS 302. Segment "C" 106 includes a fraction of one circular arc segment of the LENAS 302 offset upward by ½ nominal fin pitch, $P_f$, and rotated counterclockwise approximately 4 degrees, and more preferably approximately 3.8 degrees, about its trailing edge as shown in FIG. 8. Offset pattern 312 shown on FIG. 3 illustrates the LENAS 302 shifted or offset upward by ½ nominal fin pitch, $P_f$. The rotational angle of segment "C" 106 is measured between the tangent of the LENAS 302 and the tangent of the end of segment "C" 106. Further, the rotational angle of segment "C" 106 is related to the raising of segment "D" 108 in the enhanced base wavy pattern 400, which raising is described in greater detail below. In a preferred embodiment, the nominal fin pitch is 1/12 inch, and the fin thickness is 0.006 inch and the performance of the fin is enhanced by an inclination of 3.8 degrees. However, the angle can vary depending on the particular fin pitch and fin thickness of the heat exchanger application.

Segment "D" 108 of the preferred embodiment of the enhanced heat transfer pattern 300 begins or starts at the second inflection point of the LENAS 302 and extends to the third inflection point of the LENAS 302. Segment "D" 108 includes one circular arc segment of the LENAS 302 offset upward by ¼ nominal fin pitch, $P_f$. Offset pattern 310 shown on FIG. 3 illustrates the LENAS 302 shifted or offset upward by ¼ nominal fin pitch, $P_f$. Segment "D" 108 comprises crest 404 (see FIG. 4) of the enhanced base wavy pattern 400. Segment "D" 108 is preferably formed in its final position in the enhanced heat transfer pattern 300 during application or manufacturing of the enhanced base wavy pattern 400 to the fin stock. The positioning of segment "D" 108 of the enhanced heat transfer pattern 300 results in the contortion or deviation of the enhanced base wavy pattern 400 from LENAS 302.

Segment "E" 110 of the preferred embodiment of the enhanced heat transfer pattern 300 begins or starts at the third inflection point of the LENAS 302 and extends to the second trough 406 of the LENAS 302 (see FIG. 4). Segment "E" 110 includes a fraction of one circular arc segment of the LENAS 302 offset downward by ¼ nominal fin pitch, $P_f$. Segment "E" 110 is substantially similar to segment "B" 104.

Segment "F" 112 of the preferred embodiment of the enhanced heat transfer pattern starts or begins at the second trough 406 of the LENAS 302 and extends to the fourth inflection point of the LENAS 302. Segment "F" 112 includes a fraction of one circular arc segment of the LENAS 302 offset upward by ½ nominal fin pitch, $P_f$, and rotated clockwise approximately 4 degrees, and more preferably approximately 3.8 degrees, about its trailing edge. Segment "F" 112 is substantially similar to segment "C" 106.

Segment "G" 114 of the preferred embodiment of the enhanced heat transfer pattern 300 begins or starts at the fourth inflection point of the LENAS 302 and extends to the midpoint between successive rows of apertures 116. Segment "G" includes a fraction of one circular arc segment of the LENAS 302. Segment "G" is preferably formed in its final position in the enhanced heat transfer pattern 300 during the application or manufacturing of the enhanced base wavy pattern 400 to the fin stock. As can be seen in FIGS. 1 and 2, segment "G" 114 and segment "A" 102 are continuous when the enhanced heat transfer pattern 300 is repeated for successive rows of apertures 116.

As discussed above, FIG. 4 illustrates the enhanced base wavy pattern 400 for the fin 100. The enhanced base wavy pattern 400 includes segment "A" 102, segment "D" 108, and segment "G" 114 of the enhanced heat transfer pattern 300 for the fin 100. Segment "A" 102 and segment "D" 108 are joined together by a smooth curve through the first trough 402 and segments "D" 108 and segment "G" 114 are joined together by a smooth curve through the second trough 406. The first trough 402 is the midpoint between the trailing edge of segment "B" 104 of the enhanced heat transfer pattern 300 and the leading edge of segment "C" 106 of the enhanced heat transfer pattern 300. Similarly, the second trough 406 is the midpoint between the trailing edge of segment "E" 110 of the enhanced heat transfer pattern 300 and the leading edge of segment "F" 112 of the enhanced heat transfer pattern 300. In a preferred embodiment, the smooth curve joining segment "A" 102 and segment "D" 108 through the first trough 402 is a parabola. Alternatively, the smooth curve joining segment "A" 102 and segment "D"

108 through the first trough 402 can be a circular arc segment. In either case, the slope of the smooth curve joining segment "A" 102 and segment "D" 108 through the first trough 402 does not have to match the slopes of segment "A" 102 and segment "D" 108 at their points of intersection. Also in the preferred embodiment, the smooth curve joining segment "D" 108 and segment "G" 114 through the second trough 406 is a parabola. Alternatively, the smooth curve joining segment "D" 108 and segment "G" 114 through the second trough 406 can be a circular arc segment. Again, in either case, the slope of the smooth curve joining segment "D" 108 and segment "G" 114 through the second trough 406 does not have to match the slopes of segment "D" 108 and segment "G" 114 at their points of intersection.

Figure 5:
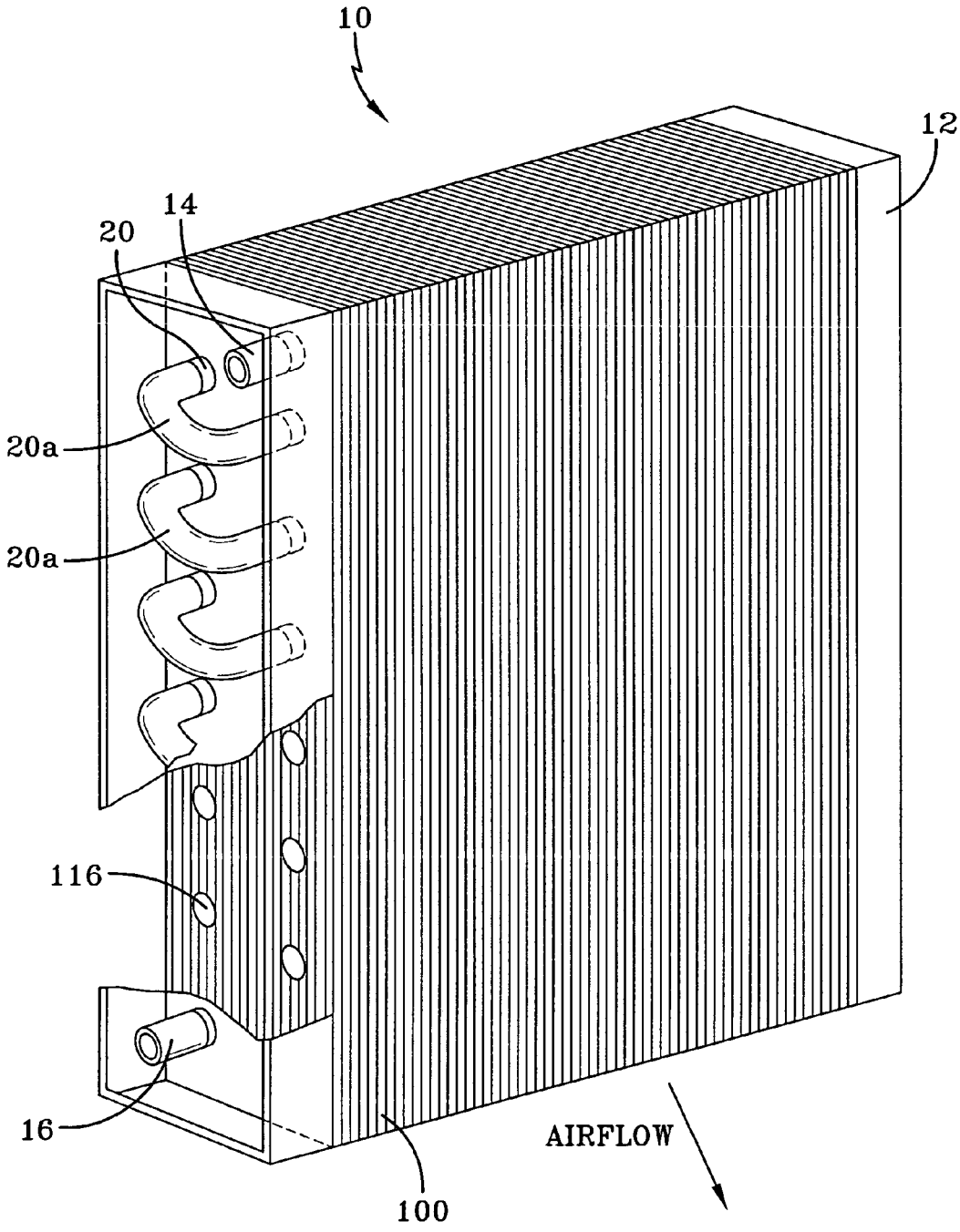
FIG. 5 is an isometric view of a heat exchanger coil assembly incorporating the fin of FIG. 1.

FIG. 5 illustrates one embodiment of a heat exchanger coil assembly 10 that can incorporate the fins and corresponding fin plates having the enhanced heat transfer pattern 300 of the present invention. The heat exchanger coil assembly 10 includes a plurality of tubes 20 extending along the length of the coil assembly 10 and arranged in proximity to each other. A plurality of tube connectors 20*a* connect the ends of a pair of the plurality of tubes 20. Each tube connector 20*a* has a substantially U-shape and connects an adjacent pair of tubes 20 to provide a serpentine path for fluid flowing through the tubes 20 and tube connectors 20*a* of the coil assembly 10. One tube 20 of the plurality of tubes 20 is connected to a fluid inlet 14 and another tube 20 of the plurality of tubes 20 is connected to a fluid outlet 16. The fluid inlet 14 and fluid outlet 16 may be located, for example, at the bottom portion of the coil assembly 10, at a side portion of the coil assembly 10 or any other suitable location on the coil assembly 10. The number of tubes 20 and their arrangement and positioning in the coil assembly 10 can vary depending on the requirements of a specific application. In one embodiment, a row of up to 24 substantially parallel tubes may be provided in the coil assembly 10. More preferably, the coil assembly 10 has two or more substantially parallel rows of up to 12 substantially parallel tubes. The tubes 20 are preferably made of copper, however, other suitable materials may also be used. The tubes 20 have a preselected cross-sectional shape, preferably a round or an oval cross-section.

During the heat transfer process, a first heat transfer fluid flows through the serpentine path formed by the plurality of tubes 20, and a second heat transfer fluid flows over the tubes 20. The plurality of tubes 20 provide an interface for the transfer of heat between the first and second heat transfer fluids. The first heat transfer fluid flowing through tubes 20 is water or a refrigerant fluid such as ammonia, ethyl chloride, Freon®, chlorofluocarbons (CFCs), hydrofluorocarbons (HFCs), and other natural refrigerants. However, it is to be understood that any suitable heat transfer fluid may be used for the first heat transfer fluid. The second heat transfer fluid is preferably air, which is being either warmed or cooled during the heat transfer process depending on the particular application. However, it is to be understood that other suitable heat transfer fluids may be used for the second heat transfer fluid. The airflow is typically forced, such as by a fan, but can be static. Adjacent to the tubes 20 are a plurality of fins 100. The transfer of heat between the first heat transfer fluid and the second heat transfer fluid occurs as the second heat transfer fluid, which is preferably air, flows over or across the tubes 20 and fins 100 of the coil assembly 10, while the first heat transfer fluid flows through the plurality of tubes 20.

The heat exchanger coil assembly 10 has a plurality of fins 100 to improve the heat transfer capabilities of the heat exchanger coil assembly 10. Each fin 100 is a thin metal plate, preferably made of a high conductivity material such as copper or aluminum, and may include a hydrophilic coating. The fins 100 include a plurality of apertures 116 for receiving each of the tubes 20. The tubes 20 preferably pass through the apertures 116 of the fins 100 at preferably a right angle to the fins 100. The tubes and fins 100 make intimate contact with one another to permit heat transfer between the two. While the fins 100 and tubes can be metallurgically joined such as by brazing or welding, the preferred embodiment of the present invention joins the fins 100 and tubes frictionally or mechanically such as by rolling. The fins 100 are preferably arranged and disposed in a substantially parallel, closely spaced relationship that has multiple paths for the second heat transfer fluid, which is preferably air, to flow between the fins 100 and across the tubes 20. The coil assembly 10 also has end plates 12 that are located on either side of the fins 100 to provide some structural support to the coil assembly 10 and to protect the fins 100 from damage.

Preferably, all of the fins 100 of a single heat exchanger coil assembly 10 have the same dimensions. The dimensions of the fins 100 of a coil assembly 10 can range from less then 1 inch to 40 inches in width and up to 72 inches in height, depending upon the intended use of the heat exchanger coil assembly 10 and the number of tubes 20. The fins preferably have a minimum thickness of about 0.002 inches, to avoid possible manufacturing problems. However, the fins can have a very large thickness if, for example, the whole coil assembly is scaled-up from dimensions of inches to dimensions of feet. In a preferred embodiment, the thickness of the fins are about 0.006 inches, 0.008 inches, and 0.010 inches. With regard to the spacing of the fins, the distances between fins is preferably not less than about 1/30 inch, otherwise there can be manufacturing difficulties. However, the fin pitch could be very large if the whole coil assembly is scaled up as described above. In a preferred embodiment, the fin pitch can range from 1/8 inch to 1/14 inch.

A fin 100 having an enhanced heat transfer pattern 300 according to the present invention is readily manufacturable. Because the enhanced heat transfer pattern 300 is continuous across the midpoint between successive rows of apertures 116, i.e. segment "A" 102 and segment "G" 114 are continuous, the fin 100 is able to span a large number of rows of apertures 116. Alternatively, several fins 100 each spanning a few rows of apertures 116 may be used. In addition, plastic deformation of the fin 100 during fabrication is reduced by offsetting segment "C" 104 and segment "F" 112 upwardly rather than downwardly, as described below.

The present invention is also directed to a method or process of manufacturing a fin 100 having the enhanced heat transfer pattern 300. The method of manufacturing a fin 100 includes applying the enhanced base wavy pattern 400 to the fin stock with a first die. Next, the fin 100 is slit or cut with a second die in a direction perpendicular to the mean airflow direction. Finally, segments of the fin stock are raised or lowered with the second die, or a third die, as appropriate, from the enhanced base wavy pattern 400 into their final positions in the enhanced heat transfer pattern 300. The apertures 116 and the collar structure are formed in the fin stock using well known techniques.

The process begins with the enhanced base wavy pattern 400 being applied or formed in the fin stock with a first die. FIG. 4 illustrates the fin 100 after the enhanced base wavy pattern 400 has been formed in the fin 100. After the enhanced base wavy pattern 400 has been formed in the fin 100, segment "A" 102, segment "D" 108, and segment "G" 114 are positioned in their final position for the enhanced heat transfer pattern 300. The formation of the enhanced base wavy pattern 400 in the fin stock, positions segment "D" 108 at an upward offset of ¼ nominal fin pitch, $P_f$, from the LENAS 302. The positioning of segment "D" 108 at this upward offset and in its final position in the enhanced heat transfer pattern 300 simplifies the manufacturing process because segment "D" 108 is positioned in one step and, thus, does not have to be cut and bent into its final position using the second die.

As discussed above, the enhanced base wavy pattern 400 is applied to the fin stock with a first die. The enhanced base wavy pattern 400 is configured to position segment "A" 102, segment "D" 108 and segment "G" 114 of the enhanced heat transfer pattern 300 in their final position. The enhanced base wavy pattern also positions a continuous segment "D" 108 across the midpoint of the enhanced base wavy pattern 400, permitting easier manufacturing of the fin 100. The enhanced base wavy pattern 400, as previously discussed, includes two parabolic regions or circular arc portions forming troughs 402, 406 that are connected by a crest portion 404. The slope of the segments forming the enhanced base wavy pattern 400 do not necessarily have to be continuous.

After the enhanced base wavy pattern 400 is applied to the fin stock, the fin stock is slit or cut with a second die, in a direction perpendicular to the mean airflow direction, to define segment "B" 104, segment "C" 106, segment "E" 110 and segment "F" 112. After the fin stock is slit or cut, segment "B" 104, segment "C" 106, segment "E" 110 and segment "F" 112 are offset or "raised" and "lowered" from the enhanced base wavy pattern 400 using a different die or in a different embodiment, the same die. During the slitting or cutting and offsetting of segment "B" 104, segment "C" 106, segment "E" 110 and segment "F" 112, segment "A" 102, segment "D" 108, and segment "G" 114 are not displaced from their positions in the enhanced base wavy pattern 400. Segment "B" 104 and segment "E" 110 of the enhanced heat transfer pattern 300 each include a fraction of one circular arc segment of the LENAS 302 offset downward by ¼ nominal fin pitch, $P_f$. Segment "B" 104 begins at the first inflection point of the LENAS 302 and extends to its first trough 402 and segment "E" 110 begins at the third inflection point of the LENAS 302 and extends to its second trough 406.

Segment "C" 106 and segment "F" 112 of the enhanced heat transfer pattern 300 each include a fraction of one circular arc segment of the LENAS 302 offset upward by ½ nominal fin pitch, $P_f$, and rotated clockwise approximately 4 degrees about its trailing edge. Segment "C" 106 begins at the first trough 402 of the LENAS 302 and extends to its second inflection point and segment "F" 112 begins at the second trough 406 of the LENAS 302 and extends to its fourth inflection point. By offsetting segment "C" 106 and segment "F" 112 in an upward direction, plastic deformation of the fin stock during fabrication of the fin 100 is reduced, compared to offsetting segment "C" 106 and segment "F" 112 in a downward direction approximately ½ nominal fin pitch in an alternate embodiment, which would result in substantially the same enhancement pattern.

Alternatively, it would be possible to form the fin 100 by applying a normal base wavy pattern 302 to the fin stock. In such a process, it would be necessary to also offset segment "D" 108 upward by ¼ nominal fin pitch, $P_f$. Additionally, it would also be possible to combine the slit and offset steps into a single step which would be performed with a single die. However, such an alternative would increase the possibility of manufacturing difficulties and is therefore a less desirable alternative.

FIGS. 6, 7, 9 10 and 12 illustrate one embodiment of a fin 100 having the enhanced heat transfer pattern 300 of the present invention. The fin 100 of FIGS. 6, 7, 9 10 and 12 is configured for use in a half-inch (½ inch) staggered equilateral tube coil having twelve (12) fins per inch. The fin 100 of FIGS. 6, 7, 9 10 and 12 has a nominal fin pitch, $P_f$, of 0.0833 inches and a longitudinal tube pitch, $P_l$, of 1.0820 inches.

Figure 7:
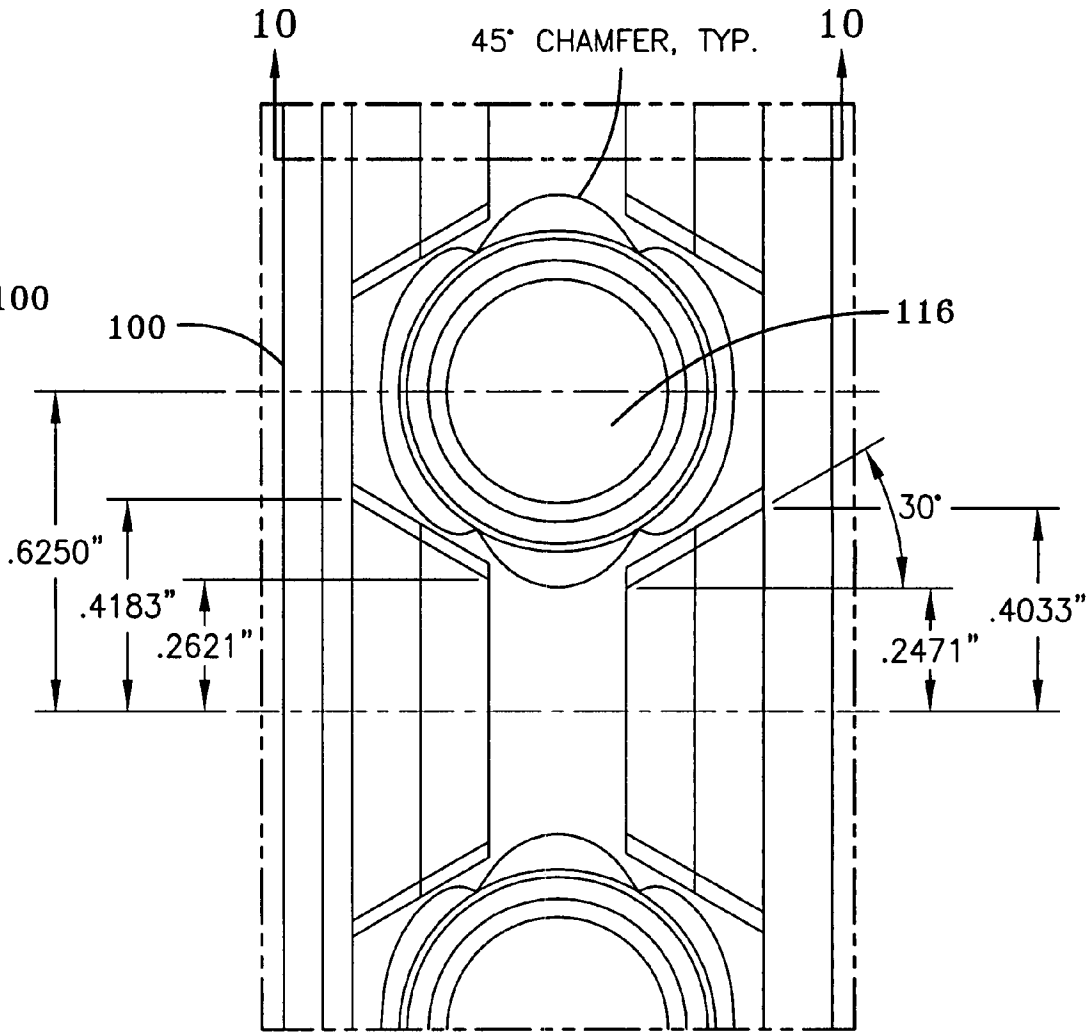
FIG. 7 is a enlarged view of the collar portion surrounding apertures of the fin of FIG. 6.
Figure 6:
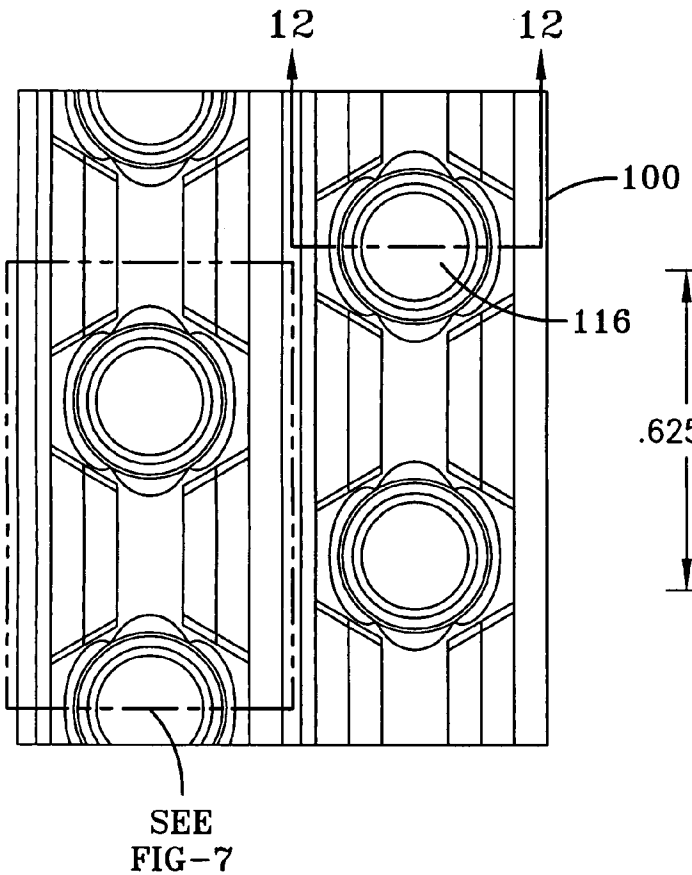
FIG. 6 is a top view of a fin from one embodiment of the present invention.
Figure 12:
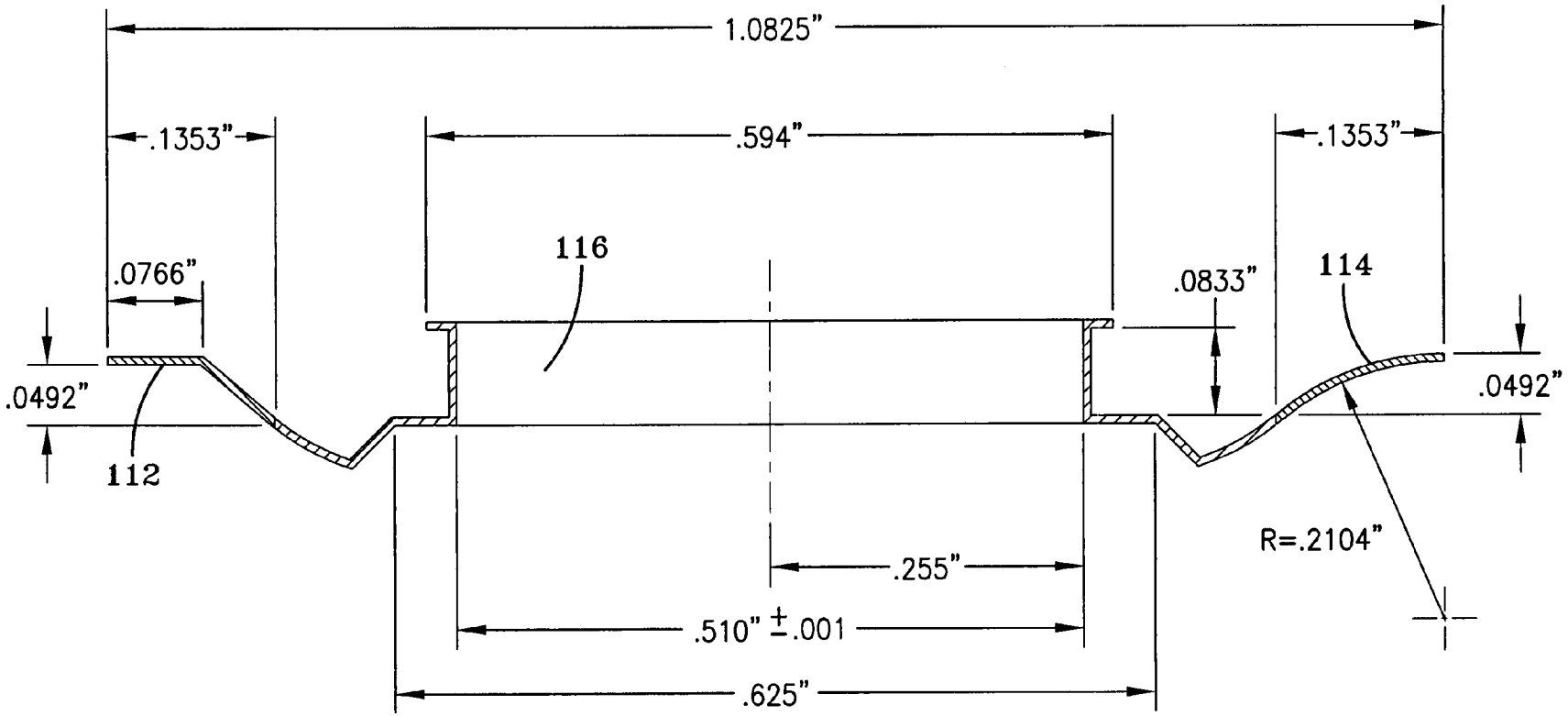
FIG. 12 is a sectional side view of a collar portion and fin taken along line 12—12 of FIG. 6.

FIG. 6 is a top view of a portion of the fin 100 and shows the staggered tube pattern of the fin 100. FIG. 7 is a enlarged view of the fin structure surrounding the apertures 116 for receiving the tubes of the heat exchanger. Some dimensions for the embodiment of the fin 100 illustrated in FIG. 7 are provided therein. FIG. 12 illustrates the collar structure surrounding the apertures of the fin 100. The collar structure of the fin 100 supports the tube passing through the aperture 116. In addition, there is a small, flat, annular section immediately surrounding the collar structure that acts as a spring to keep the collar structures in physical contact with the tubes. This small disk is part of the "base fin plate". The size of the transition region between the small flat disk and the enhanced heat transfer pattern 300 is kept to a minimum, constrained by material stretching limitations, in order to maximize the area of the fin formed into the enhanced heat transfer pattern.

As can be seen in FIG. 12, segment "A" 102 and segment "G" 114 are continuous about the collar structure. As discussed above, segment "A" 102 can operate as a condensate channel, because the continuity of segment "A" 102 is not interrupted by the collar structure. The collar structure has a lip that is raised from the base fin plate a distance approximately equal to the fin pitch, $P_f$. As shown in FIG. 12, the height to the top surface of the raised lip, measured from the bottom surface of the base fin plate, is about 0.0833, which corresponds to the fin pitch, $P_f$, for this embodiment. The height of the lip from the base fin plate will vary based on the particular fin pitch, $P_f$, of the heat exchanger application. For example, the height of the lip for 6 fins per inch (fpi) is about 0.1667 inches, for 8 fpi, the height of the lip is about 0.1250 inches, for 10 fpi, the height of the lip is about 0.1000 inches, and for 14 fpi, the height of the lip is about 0.0714 inches. Preferably, the lip is in contact with an adjacent fin 100, when the fin 100 is arranged in a heat exchanger application. The contact of the lip against the adjacent fin 100, provides some support for the tubes and increases the rigidity of the fins 100 in the heat exchanger application.

Figure 9:
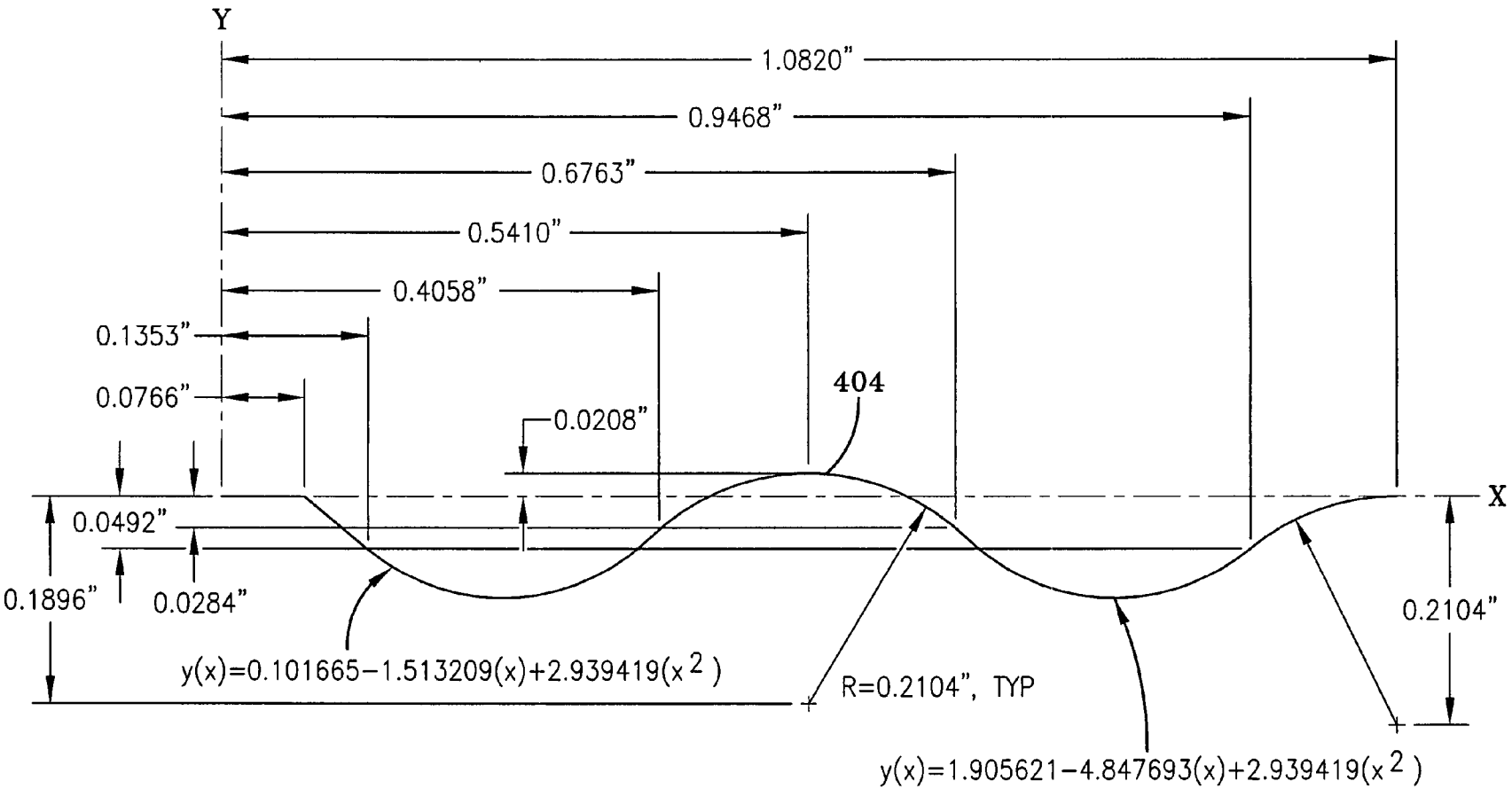
FIG. 9 is a sectional side view of an enhanced base wavy pattern corresponding to the enhanced heat transfer pattern illustrated in FIG. 10.
Figure 10:
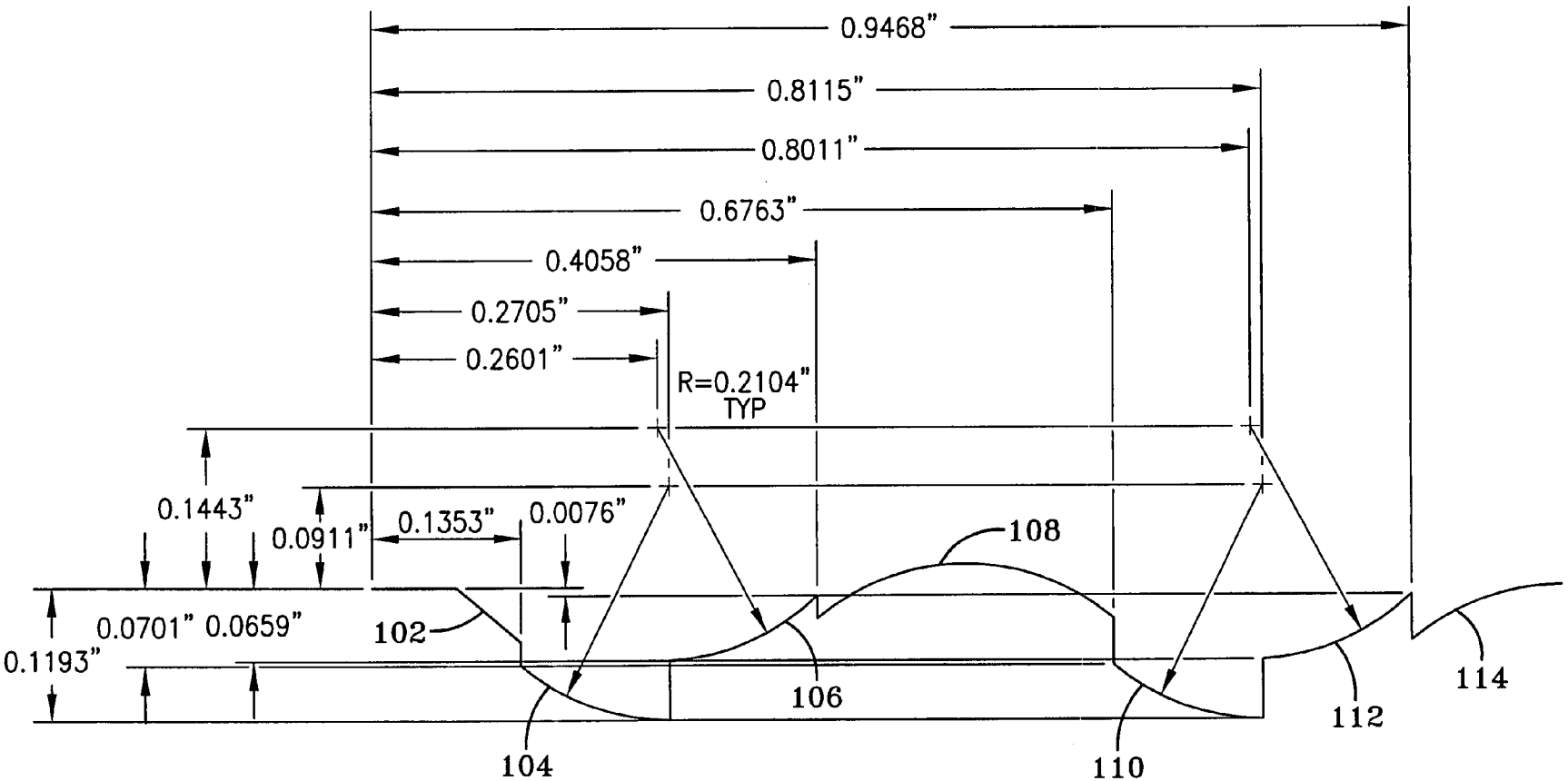
FIG. 10 is a sectional side view of the fin taken along line 10—10 of FIG. 7 showing the enhanced heat transfer pattern of the present invention.

FIG. 10 is a cross-section of the fin 100 having the enhanced heat transfer pattern 300 shown in FIG. 7. FIG. 9 illustrates the fin stock of the fin 100 after the enhanced base wavy pattern 400 has been applied, but before segment "B" 104, segment "C" 106, segment "E" 110 and segment "F" 112 have been slit and offset from the enhanced base wavy pattern 400 as shown in FIG. 10.

FIG. 9 illustrates the enhanced base wavy pattern 400 used to create the enhanced heat transfer pattern 300 shown in FIG. 10. The enhanced base wavy pattern 400 of FIG. 9 includes a first parabolic portion determined by the equation $y(x)=0.0101665-1.513209(x)+2.939419(x^2)$ and a second parabolic portion determined by the equation $y(x)=1.905621-4.847693(x)+2.939419(x^2)$, where "x" is the absolute distance from the datum line labeled "X" as shown on FIG. 9 and "y" is the absolute distance from the datum line labeled "Y" as shown on FIG. 9. The two parabolic portions are connected by a crest or arc portion 404 having a radius of curvature of 0.2104 inches. The above dimensions and equations apply to the embodiment where $P_f$=1/12" and $P_l$=1.0820". The above dimensions and equations will differ for other embodiments having a different fin pitch and tube pitch.

As discussed in greater detail above, segment "A" 102, segment "D" 108 and segment "G" 114 are formed in their final position in the enhanced heat transfer pattern upon the formation of the enhanced base wavy pattern 400 in the fin stock. Segment "B" 104, segment "C" 106, segment "E" 110 and segment "F" 112 are offset from the enhanced base wavy pattern 400 and the LENAS 302 into the final positions in the enhanced heat transfer pattern.

The enhanced heat transfer pattern 300 of the present invention represents a new and highly effective fin geometry for use in plate fin and tube heat exchangers 10 for heating and cooling applications. A fin 100 having the enhanced heat transfer pattern 300 according to the present invention produces a high, air-side, convective heat transfer coefficient and a relatively low air-side pressure drop. The geometry of the fin 100 permits the fin 100 to maintain thin thermal boundary layers adjacent to the surfaces of the enhanced heat transfer pattern 300. Positioning of the offset fin segments 102–114 minimizes the impact of each segment's thermal wake on heat transfer from down stream segments 102–114. In the enhanced heat transfer pattern 300 of the present invention, the airflow streamlines tend toward a generally sinusoidal pattern, previously described as the LENAS 302 and illustrated in FIG. 3. The seven segments 102–114 of the enhanced heat transfer pattern 300 are offset from the LENAS 302 by varying distances which prevents the wake of any one segment from interfering with heat transfer from at least the next two segments downstream. The distribution of the seven segments 102–114 also retards development of secondary flow patterns (Taylor/Goertler vortices), which tend to result from the curvature of the air streamlines and which erode heat transfer coefficient to pressure drop ratio.

A fin 100 having the enhanced heat transfer pattern 300 according to the present invention also has a relatively high face velocity corresponding to incipient condensate carryover. As discussed previously, during cooling or dehumidifying applications the air passing through the coil assembly 10 becomes saturated with moisture, and this moisture can interfere with heat transfer when condensate forms on the fin 100. Alternatively, if the moisture remains in the air, the air dispensed by the coil assembly 10 will be wet, which is also undesirable.

As discussed above, segment "A" 102 has two portions which preferably form an angle of approximately 40 degrees to act as a condensate channel to transport condensate down off the fin 100. Condensation gathers in the channel formed by the angle due to capillary forces. The gathered condensation forms a thicker than average condensable film on the concave side of the angle. The thickness of the condensate film increases the speed at which it flows off of the fin 100, under the influence of gravity, relative to a thinner film. In addition, because the condensate gathers on the concave side of the angle, the condensate is shielded from the airflow and is not likely to be re-entrained into the airstream.

In addition to the condensate channel, the curvilinear shape of the airflow streamlines acts to remove liquid condensate droplets from the air. The curvilinear shape of the airflow streamlines leads to inertial separation of entrained liquid droplets from the bulk airflow onto the surface of the fin. The particular order and distances of the segments 102–114 offset from the LENAS 302 in the enhanced heat transfer pattern 300 of the present invention positions each segment to catch liquid droplets entrained in the airflow from the trailing edge of an upstream segment. Generally, the curved shaped and positioning of the segments 102–114 will not permit liquid entrained from one segment to be carried more than two segments downstream before it is "caught" and removed from the airflow. This is accomplished using the concept of centrifugal separation of entrained liquid from air, wherein the liquid is more dense than the air and tends to travel straight as the air travels around a curve. This means that any liquid carried by the air flowing over the curved surface of the segments 102–114 is likely to travel straight, and hit one of the segments 102–114, removing the liquid from the air.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat exchanger coil assembly comprising:

a plurality of heat transfer tubes, the plurality of heat transfer tubes being positioned into at least one row, and the plurality of heat transfer tubes being disposed substantially parallel to one another;

a plurality of fins in contact with the plurality of heat transfer tubes, the plurality of fins being disposed substantially perpendicular to the plurality of heat transfer tubes and substantially parallel to one another;

each fin of the plurality of fins having a predetermined pattern for each row of heat transfer tubes, the predetermined pattern having a substantially sinusoidal shape, the predetermined pattern comprising seven discrete segments, each segment of the seven discrete segments being disposed with respect to a predefined reference shape; and wherein, at least one segment of the seven discrete segments is disposed at an offset of a first distance from the predefined reference shape and at least one other segment of the seven discrete segments is disposed at an offset of a second distance greater than the first distance from the predefined reference shape.

2. The heat exchanger coil assembly of claim 1 wherein:

the predetermined pattern has a first end and second end opposite the first end; and the seven discrete segments comprises a first segment, the first segment being disposed adjacent to the first end of the predetermined pattern, and the first segment being disposed substantially on the predefined reference shape.

3. The heat exchanger coil assembly of claim 2 wherein the first segment comprises a first linear portion and a second linear portion, the first linear portion and the second linear portion being disposed to form an angle of about 40 degrees.

4. The heat exchanger coil assembly of claim 2 wherein the seven discrete segments comprise a second segment disposed adjacent to the first segment, the second segment being disposed at an offset of the first distance from the predefined reference shape.

5. The heat exchanger coil assembly of claim 4 wherein the second segment is offset below the predefined reference shape in a direction substantially perpendicular to airflow through the heat exchanger coil assembly.

6. The heat exchanger coil assembly of claim 4 wherein the seven discrete segments comprise a third segment disposed adjacent to the second segment, the third segment being disposed at an offset of the second distance from the predefined reference shape.

7. The heat exchanger coil assembly of claim 6 wherein the third segment is offset above the predefined reference shape in a direction substantially perpendicular to airflow through the heat exchanger coil assembly.

8. The heat exchanger coil assembly of claim 6 wherein the third segment has a first end adjacent the second segment and a second end opposite the first end, the first end of the third segment being displaced about 4 degrees from the predefined reference shape.

9. The heat exchanger coil assembly of claim 6 wherein the seven discrete segments comprise a fourth segment disposed adjacent to the third segment, the fourth segment being disposed at an offset of the first distance from the predefined reference shape.

10. The heat exchanger coil assembly of claim 9 wherein the fourth segment is offset above the predefined reference shape in a direction substantially perpendicular to airflow through the heat exchanger coil assembly.

11. The heat exchanger coil assembly of claim 9 wherein the seven discrete segments comprise a fifth segment disposed adjacent to the fourth segment, the fifth segment being disposed at an offset of the first distance from the predefined reference shape.

12. The heat exchanger coil assembly of claim 11 wherein the fifth segment is offset below the predefined reference shape in a direction substantially perpendicular to airflow through the heat exchanger coil assembly.

13. The heat exchanger coil assembly of claim 11 wherein the seven discrete segments comprise a sixth segment disposed adjacent to the fifth segment, the sixth segment being disposed at an offset of the second distance from the predefined reference shape.

14. The heat exchanger coil assembly of claim 13 wherein the sixth segment is offset above the predefined reference shape in a direction substantially perpendicular to airflow through the heat exchanger coil assembly.

15. The heat exchanger coil assembly of claim 13 wherein the seven discrete segments comprises a seventh segment, the seventh segment being disposed adjacent to both the second end of the predetermined pattern and the sixth segment, and the seventh segment being disposed substantially on the predefined reference shape.

16. The heat exchanger coil assembly of claim 15 wherein:

the at least one row of heat transfer tubes comprises a plurality of rows; and the seventh segment of the predetermined pattern of one row of heat transfer tubes is continuous with the first segment of the predetermined pattern of an adjacent row of heat transfer tubes.

17. The heat exchanger coil assembly of claim 1 wherein:

the plurality of fins having a predetermined fin pitch;

the first distance is a first predefined fraction of the predetermined fin pitch; and the second distance is a second predefined fraction of the predetermined fin pitch.

18. The heat exchanger coil assembly of claim 17 wherein the first predefined fraction is one quarter of the predetermined fin pitch.

19. The heat exchanger coil assembly of claim 18 wherein the second predefined fraction is one half of the predetermined fin pitch.

20. The heat exchanger coil assembly of claim 1 wherein:

each fin of the plurality of fins having a height measured substantially perpendicular to airflow through the heat exchanger coil assembly and a width measured substantially parallel to the airflow through the heat exchanger coil assembly; and at least one segment of the seven discrete segments extends continuously along the height of the fin.

21. The heat exchanger coil assembly of claim 20 wherein six segments of the seven discrete segments have a first width and a seventh segment of the seven discrete segments has a second width greater than the first width.

22. The heat exchanger coil assembly of claim 21 wherein the second width is twice the first width.

23. The heat exchanger coil assembly of claim 21 wherein the seventh segment of the seven discrete segments is disposed centrally in the predetermined pattern.

24. The heat exchanger coil assembly of claim 1 wherein:

the at least one row of heat transfer tubes comprises a plurality of rows;

each fin of the plurality of fins having tube pitch corresponding to the distance between adjacent rows of heat transfer tubes; and the predetermined pattern having a wavelength of one half of the tube pitch.

25. A fin plate for a heat exchanger coil assembly having a predetermined fin pitch and a plurality of tubes arranged into a plurality of rows, the fin plate comprising:

a predetermined pattern for each row of tubes, the predetermined pattern having a substantially sinusoidal shape, the predetermined pattern comprising seven discrete segments, each segment of the seven discrete segments being disposed with respect to a predefined reference shape; and wherein, at least one segment of the seven discrete segments is disposed at an offset from the predefined reference shape by a first fraction of the predetermined fin pitch and at least one other segment of the seven discrete segments is disposed at an offset from the predefined reference shape by a second fraction of the predetermined fin pitch.

26. The fin plate of claim 25 further comprising a plurality of apertures corresponding to the plurality of tubes, the plurality of apertures being arranged into a plurality of rows, and each aperture of the plurality of apertures being configured and disposed to receive a corresponding tube of the plurality of tubes.

27. The fin plate of claim 25 wherein:

the predetermined pattern has a first end and second end opposite the first end; and the seven discrete segments comprises a first segment disposed adjacent to the first end of the predetermined pattern, a second segment disposed adjacent to the first segment, a third segment disposed adjacent to the second segment, a fourth segment disposed adjacent to the third segment, a fifth segment disposed adjacent to the fourth segment, a sixth segment disposed adjacent to the fifth segment and a seventh segment disposed adjacent to both the sixth segment and the second end of the predetermined pattern.

28. The fin plate of claim 27 wherein the first segment is disposed substantially on the predefined reference shape and comprises a first linear portion and a second linear portion, the first linear portion and the second linear portion being configured and disposed to form a condensate channel for removal of condensate from the fin plate.

29. The fin plate of claim 28 wherein the first linear portion and the second linear portion are disposed to form an angle of about 40 degrees.

30. The fin plate of claim 27 wherein the second segment, the third segment, the fourth segment, the fifth segment and the sixth segment are offset from the predetermined reference shape in a direction substantially perpendicular to airflow through the heat exchanger coil assembly.

31. The fin plate of claim 30 wherein the second segment is disposed at an offset below the predetermined reference shape by the first fraction of the predetermined fin pitch.

32. The fin plate of claim 30 wherein the third segment is disposed at an offset above the predefined reference shape by the second fraction of the predetermined fin pitch.

33. The fin plate of claim 32 wherein the third segment has a first end adjacent the second segment and a second end opposite the first end, the first end of the third segment being displaced about 4 degrees from the predefined reference shape.

34. The fin plate of claim 30 wherein the fourth segment is disposed at an offset above the predefined reference shape by the first fraction of the predetermined fin pitch.

35. The fin plate of claim 30 wherein the fifth segment is disposed at an offset below the predefined reference shape by the first fraction of the predetermined fin pitch.

36. The fin plate of claim 30 wherein the sixth segment is disposed at an offset above the predefined reference shape by the second fraction of the predetermined fin pitch.

37. The fin plate of claim 36 wherein the sixth segment has a first end adjacent the fifth segment and a second end opposite the first end, the first end of the sixth segment being displaced about 4 degrees from the predefined reference shape.

38. The fin plate of claim 27 wherein the seventh segment is disposed substantially on the predefined reference shape.

39. The fin plate of claim 27 wherein the seventh segment of the predetermined pattern of one row of tubes is continuous with the first segment of the predetermined pattern of an adjacent row of tubes.

40. The fin plate of claim 25 wherein the first predefined fraction of the predetermined fin pitch is one quarter of the predetermined fin pitch.

41. The fin plate of claim 40 wherein the second predefined fraction of the predetermined fin pitch is one half of the predetermined fin pitch.

42. The fin plate of claim 27 wherein the first segment and the seventh segment of the predetermined pattern each extend continuously in a direction substantially parallel to a corresponding row of heat transfer tubes.

43. The fin plate of claim 27 wherein the first segment, the second segment, the third segment, the fifth segment, the sixth segment and the seventh segment each have a first width and the fourth segment has a second width greater than the first width.

44. The fin plate of claim 43 wherein the second width is twice the first width.

45. A fin plate for a heat exchanger coil assembly having a predetermined fin pitch and a plurality of tubes arranged into a plurality of rows, the fin plate comprising:

a predetermined pattern for each row of tubes, the predetermined pattern being an enhanced base wavy pattern based on a leading edge nominal air streamline, the enhanced base wavy pattern having a substantially sinusoidal shape, the enhanced base wavy pattern having a first end and second end opposite the first end, the enhanced base wavy pattern comprising seven discrete segments, each segment of the seven discrete segments being disposed with respect to the leading edge nominal air streamline;

the seven discrete segments including a first segment disposed adjacent to the first end of the enhanced base wavy pattern; and wherein, the first segment comprises a first linear portion and a second linear portion, the first linear portion and the second linear portion being configured and disposed to form a condensate channel for removal of condensate from the fin plate.

46. The fin plate of claim 45 wherein the first linear portion and the second linear portion are disposed to form an angle of about 40 degrees.

47. The fin plate of claim 45 wherein at least one segment of the seven discrete segments is disposed at an offset from the leading edge nominal air streamline by a first fraction of the predetermined fin pitch and at least one other segment of the seven discrete segments is disposed at an offset from the leading edge nominal air streamline by a second fraction of the predetermined fin pitch.

48. The fin plate of claim 47 wherein the first segment is disposed substantially on the leading edge nominal air streamline.

49. The fin plate of claim 45 wherein the first segment of the enhanced base wavy pattern extends continuously in a direction substantially parallel to a corresponding row of tubes.

* * * * *